US006070878A

United States Patent [19]

Jones et al.

[11] Patent Number: 6,070,878

[45] **Date of Patent: *Jun. 6, 2000**

[54] APPARATUS FOR PROGRESSIVE JACKPOT GAMING

[75] Inventors: Daniel A. Jones; James P. Suttle, both of Las Vegas, Nev.

[73] Assignee: Progressive Games, Inc., Las Vegas, Nev.

[ * ] Notice: This patent is subject to a terminal disclaimer.

[21] Appl. No.: 09/301,676

[22] Filed: Apr. 28, 1999

Related U.S. Application Data

[63] Continuation of application No. 08/967,849, Nov. 12, 1997, which is a continuation of application No. 08/695,275, Aug. 9, 1996, Pat. No. 5,794,964, which is a continuation of application No. 08/486,700, Jun. 7, 1995, Pat. No. 5,544,893, which is a continuation of application No. 08/377,661, Nov. 8, 1994, Pat. No. 5,626,341, which is a division of application No. 08/040,925, Mar. 31, 1993, Pat. No. 5,364,104, which is a division of application No. 07/800,631, Nov. 27, 1991, Pat. No. 5,288,077, which is a continuation-in-part of application No. 07/361,276, Jun. 5, 1989, Pat. No. 5,078,405, which is a division of application No. 07/214,934, Jul. 5, 1988, Pat. No. 4,861,041, which is a continuation-in-part of application No. 07/182,374, Apr. 18, 1988, Pat. No. 4,836,553.

[51] Int. Cl.[7] ..... A63F 9/24; A63F 1/06

[52] U.S. Cl. ..... 273/309; 273/292; 463/12; 463/13; 463/25; 463/27; 463/29

[58] Field of Search ..... 463/12, 13, 42, 463/46, 16–20, 25–28, 29; 273/292, 309, 274, 138.2, 138.1, 139

[56] References Cited

U.S. PATENT DOCUMENTS

| | | | |
|---|---|---|---|
| D. 105,610 | 8/1937 | Posey | D6/618 |
| D. 118,451 | 1/1940 | Radford | D21/26 |
| D. 183,007 | 6/1958 | Lord | D21/26 |
| D. 213,891 | 4/1969 | Schultz | D21/32 |

(List continued on next page.)

FOREIGN PATENT DOCUMENTS

| | | |
|---|---|---|
| 621599 | 4/1989 | Australia . |
| 628044 | 4/1989 | Australia . |

(List continued on next page.)

OTHER PUBLICATIONS

Winning Gamer, Issue #5, Feb. 1985, Pi Yee Press, LaJolla, CA.
Winning Gamer, Issue #6, Mar. 1985, Pi Yee Press, LaJolla, CA.
Winning Gamer, Issue #15, Dec. 1985, Pi Yee Press, LaJolla, CA.
Winning Gamer, Issue #19, Apr. 1986, Pi Yee Press, La Jolla, CA.
Winning Gamer, Issue #20, May 1986, Pi Ye Press, La Jolla, CA.
Winning Gamer, Issue #21, Jun. 1986, Pi Ye Press, La Jolla, CA.
Affidavit of John F. Acres, Oct. 4, 1993.
Affidavit of William Randal Adams, Oct. 4, 1993.
Affidavit of Derell M. Johns, Nov. 19, 1993.
Affidavit of Terry Oliver, Nov. 22, 1993.

(List continued on next page.)

*Primary Examiner*—Benjamin H. Layno

[57] ABSTRACT

A method and apparatus for including a progressive jackpot component in a live casino table game. In addition to playing a live casino table game, each player makes an additional wager at the beginning of each hand that makes that player eligible to win all or part of a jackpot. If during the play of the hand a player is dealt a predetermined arrangement of cards, the player wins a preselected percentage of the jackpot amount. The jackpot is progressive in that unwon amounts of the jackpot carry over to the next hand. Apparatus is provided to receive each gaming token wagered for the jackpot component, to increment the jackpot meter which displays the jackpot amount, to decrement the jackpot meter whenever a winning hand is paid and to reset the apparatus for the next hand.

110 Claims, 4 Drawing Sheets

U.S. PATENT DOCUMENTS

| | | | |
|---|---|---|---|
| D. 220,635 | 5/1971 | Boyer et al. | D21/30 |
| D. 245,717 | 9/1977 | Jessie | D21/32 |
| D. 263,975 | 4/1982 | Quisuga et al. | D21/37 |
| D. 311,474 | 10/1990 | Hoffman | D6/618 |
| 1,238,736 | 9/1917 | Barrett | 453/18 |
| 1,527,929 | 2/1925 | Simons | 273/274 |
| 1,763,476 | 6/1930 | Morris | 273/309 |
| 1,970,876 | 8/1934 | Anderson | 273/309 |
| 2,008,829 | 7/1935 | Israel | 273/148 A |
| 2,199,745 | 5/1940 | Harris | 273/309 |
| 3,011,789 | 12/1961 | Eliassen et al. | 273/148 A |
| 3,269,503 | 8/1966 | Foster | 463/26 |
| 3,556,531 | 1/1971 | Elder | 273/143 R |
| 3,663,021 | 5/1972 | Whippo | 273/274 |
| 3,667,757 | 6/1972 | Holmberg | 273/274 |
| 3,689,071 | 9/1972 | Kucera | 273/281 |
| 3,796,433 | 3/1974 | Fraley et al. | 463/12 |
| 3,825,255 | 7/1974 | Kennard et al. | 273/139 |
| 3,874,671 | 4/1975 | Smith | 273/254 |
| 3,876,208 | 4/1975 | Wachtler et al. | 463/13 |
| 3,998,462 | 12/1976 | Goott | 273/274 |
| 4,063,680 | 12/1977 | Leo | 232/10 |
| 4,099,722 | 7/1978 | Rodesch et al. | 273/143 R |
| 4,232,866 | 11/1980 | Pennachio | 273/374 |
| 4,302,012 | 11/1981 | Di Giovanni et al. | 273/148 R |
| 4,305,586 | 12/1981 | Richards | 273/274 |
| 4,312,508 | 1/1982 | Wood | 273/274 |
| 4,364,567 | 12/1982 | Goott | 273/237 |
| 4,397,469 | 8/1983 | Carter, III | 273/149 R |
| 4,518,001 | 5/1985 | Branham | 453/49 |
| 4,531,187 | 7/1985 | Uhland | 364/410 |
| 4,569,526 | 2/1986 | Hamilton | 273/242 |
| 4,575,085 | 3/1986 | Ollington | 273/138.1 |
| 4,614,342 | 9/1986 | Takashima | 463/11 |
| 4,624,459 | 11/1986 | Kaufman | 273/143 R |
| 4,648,604 | 3/1987 | Horan | 273/292 |
| 4,651,997 | 3/1987 | Wood | 273/274 |
| 4,666,160 | 5/1987 | Hamilton | 273/242 |
| 4,700,948 | 10/1987 | Okada | 273/143 R |
| 4,721,307 | 1/1988 | Okada | 273/143 R |
| 4,743,022 | 5/1988 | Wood | 463/13 |
| 4,756,531 | 7/1988 | DiRe et al. | 463/18 |
| 4,759,549 | 7/1988 | Beckwith | 273/274 |
| 4,760,527 | 7/1988 | Sidley | 364/412 |
| 4,813,675 | 3/1989 | Greenwood | 463/46 |
| 4,836,546 | 6/1989 | DiRe et al. | 463/18 |
| 4,836,553 | 6/1989 | Suttle et al. | 273/292 |
| 4,837,728 | 6/1989 | Barrie et al. | 364/412 |
| 4,861,041 | 8/1989 | Jones et al. | 273/292 |
| 4,926,327 | 5/1990 | Sidley | 364/412 |
| 4,948,134 | 8/1990 | Suttle et al. | 463/13 |
| 4,964,638 | 10/1990 | Ishida | 463/27 |
| 5,007,519 | 4/1991 | Mercurio | 194/230 |
| 5,019,973 | 5/1991 | Wilcox et al. | 364/412 |
| 5,022,653 | 6/1991 | Suttle et al. | 463/13 |
| 5,042,818 | 8/1991 | Weingardt | 273/292 |
| 5,078,405 | 1/1992 | Jones et al. | 273/309 |
| 5,092,598 | 3/1992 | Kamille | 273/139 |
| 5,098,107 | 3/1992 | Boylan et al. | 273/292 |
| 5,100,137 | 3/1992 | Fulton | 463/13 |
| 5,106,089 | 4/1992 | Wood | 273/139 |
| 5,112,060 | 5/1992 | Jones | 273/309 |
| 5,154,429 | 10/1992 | Le Vasseur | 273/292 |
| 5,167,413 | 12/1992 | Fulton | 463/13 |
| 5,248,142 | 9/1993 | Breeding | 273/138.1 |
| 5,249,800 | 10/1993 | Hilgendorf et al. | 463/27 |
| 5,251,897 | 10/1993 | Fulton | 463/13 |
| 5,255,915 | 10/1993 | Miller | 463/13 |
| 5,257,784 | 11/1993 | Boylan et al. | 273/138.1 |
| 5,257,810 | 11/1993 | Schorr et al. | 273/292 |
| 5,265,877 | 11/1993 | Boylan et al. | 273/139 |
| 5,275,400 | 1/1994 | Weingardt et al. | 463/12 |
| 5,275,411 | 1/1994 | Breeding | 273/149 R |
| 5,275,415 | 1/1994 | Wisted | 273/274 |
| 5,277,424 | 1/1994 | Wilms | 463/12 |
| 5,286,023 | 2/1994 | Wood | 273/138.2 |
| 5,288,077 | 2/1994 | Jones | 273/292 |
| 5,288,081 | 2/1994 | Breeding | 273/292 |
| 5,294,128 | 3/1994 | Marquez | 273/292 |
| 5,322,295 | 6/1994 | Cabot et al. | 273/292 |
| 5,364,104 | 11/1994 | Jones et al. | 273/292 |
| 5,364,105 | 11/1994 | Jones | 273/292 |
| 5,374,067 | 12/1994 | Jones | 273/292 |
| 5,377,973 | 1/1995 | Jones | 273/309 |
| 5,377,994 | 1/1995 | Jones | 273/309 |
| 5,380,012 | 1/1995 | Jones et al. | 273/292 |
| 5,382,025 | 1/1995 | Sklansky et al. | 273/292 |
| 5,390,934 | 2/1995 | Grassa | 273/292 |
| 5,393,067 | 2/1995 | Paulsen et al. | 273/292 |
| 5,401,023 | 3/1995 | Wood | 463/13 |
| 5,411,257 | 5/1995 | Fulton | 463/13 |
| 5,417,430 | 5/1995 | Breeding | 273/292 |
| 5,437,462 | 8/1995 | Breeding | 273/292 |
| 5,445,391 | 8/1995 | Gleason, Jr. | 273/304 |
| 5,472,194 | 12/1995 | Breeding et al. | 463/27 |
| 5,489,101 | 2/1996 | Moody | 273/292 |
| 5,494,296 | 2/1996 | Grassa | 273/292 |
| 5,511,781 | 4/1996 | Wood et al. | 463/13 |
| 5,531,448 | 7/1996 | Moody | 273/292 |
| 5,536,016 | 7/1996 | Thompson | 273/269 |
| 5,573,245 | 11/1996 | Weiner et al. | 273/153 R |
| 5,577,731 | 11/1996 | Jones | 273/292 |
| 5,584,485 | 12/1996 | Jones et al. | 273/292 |
| 5,597,162 | 1/1997 | Franklin | 273/292 |
| 5,605,504 | 2/1997 | Huang | 463/22 |
| 5,626,341 | 5/1997 | Jones et al. | 273/292 |
| 5,636,843 | 6/1997 | Roberts | 273/292 |
| 5,664,781 | 9/1997 | Feola | 273/292 |
| 5,695,402 | 12/1997 | Stupak | 463/20 |
| 5,713,573 | 2/1998 | Nazaryan | 273/292 |
| 5,718,631 | 2/1998 | Invencion | 463/19 |
| 5,725,216 | 3/1998 | Jones | 273/292 |
| 5,732,950 | 3/1998 | Moody | 273/292 |
| 5,743,798 | 4/1998 | Adams et al. | 463/17 |
| 5,755,621 | 5/1998 | Marks et al. | 463/42 |
| 5,770,533 | 6/1998 | Franchi | 463/42 |
| 5,772,211 | 6/1998 | Nazaryan et al. | 273/292 |
| 5,775,992 | 7/1998 | Wood et al. | 463/13 |
| 5,785,593 | 7/1998 | Wood et al. | 463/13 |
| 5,788,241 | 8/1998 | Ung | 273/292 |
| 5,794,964 | 8/1998 | Jones et al. | 273/309 |
| 5,795,225 | 8/1998 | Jones et al. | 463/13 |
| 5,803,809 | 9/1998 | Yoseloff | 463/13 |
| 5,810,361 | 9/1998 | Kadlic | 273/292 |
| 5,823,873 | 10/1998 | Moody | 463/13 |
| 5,839,730 | 11/1998 | Pike | 273/292 |
| 5,839,731 | 11/1998 | Feola | 273/292 |
| 5,842,698 | 12/1998 | Brown | 273/292 |
| 5,845,906 | 12/1998 | Wirth | 273/274 |
| 5,851,147 | 12/1998 | Stupak et al. | 463/13 |
| 5,851,148 | 12/1998 | Brune et al. | 463/25 |
| 5,868,618 | 2/1999 | Netley et al. | 463/13 |
| 5,868,619 | 2/1999 | Wood et al. | 463/13 |
| 5,882,259 | 3/1999 | Holmes, Jr. et al. | 463/13 |
| 5,882,260 | 3/1999 | Marks et al. | 463/13 |

FOREIGN PATENT DOCUMENTS

| | | |
|---|---|---|
| 96049 | 4/1989 | Austria . |
| 1334983 | 3/1995 | Canada . |
| 1335381 | 4/1995 | Canada . |
| 4792 | 6/1991 | Dominican Rep. . |
| 4793 | 6/1991 | Dominican Rep. . |

| | | |
|---|---|---|
| 4825 | 3/1993 | Dominican Rep. . |
| 4999 | 9/1993 | Dominican Rep. . |
| 338644B1 | 4/1989 | European Pat. Off. . |
| 2830216 | 1/1980 | Germany . |
| 3003376 | 8/1981 | Germany . |
| 68909992 | 4/1989 | Germany . |
| 0338644 | 4/1989 | Italy . |
| 135187 | 6/1988 | Japan . |
| 4-371186 | 4/1991 | Japan . |
| 2083936 | 3/1982 | United Kingdom . |
| 2097570 | 11/1982 | United Kingdom . |
| 2177610A | 7/1985 | United Kingdom . |
| 2169736 | 7/1986 | United Kingdom . |
| 2184029 | 6/1987 | United Kingdom . |
| 93/10869 | 6/1993 | WIPO . |
| 94/15684 | 7/1994 | WIPO . |
| 95/21665 | 8/1995 | WIPO . |
| 97/13562 | 4/1997 | WIPO . |
| 92/20417 | 11/1997 | WIPO . |

OTHER PUBLICATIONS

Affidavit of Nick Edward Greenwood, Nov. 23, 1993.
Affidavit of Michael Spencer Stone, Nov. 23, 1993.
Scarne, Scarne's Encyclopedia of Games, Harper & Row, N.Y., Copyright 1973, p. 381, 383 and title pages.
Scarne, Scarne's Encyclopedia of Games, Harper & Row, N.Y., Copyright 1973, p. 33–41 and title pages.
Scarne, Scarne's New Complete Guide To Gambling, Simon & Schuster, N.Y., Copyright 1961, p. 440–445.
Scarne, Scarne's Encyclopedia of Games, Harper & Row, N.Y.,Copyright 1983, p. 299–305; 383 and title pages.
W.E. Gibson, Hoyle's Modern Encyclopedia of Card Games, p. 218–9, 369–70 (1974).
Casino Player, vol. IV, No. 12, Aug. 1993, "My Biggest Slot Jackpot", Stanford Wong.
Gaming Concepts, Inc. "Over/Under 13 Blackjack" brochure, 1988.
Casino Gaming, Sep. 1988, "Aruba Deals a New Game: Caribbean Stud Poker", p. 12–13.
Casino Journal, vol. 8, No. 12, Dec. 1992, "Working Within the Systems: IGT's linked progressive programs take leap to the tables", p. 10–15, 40, 41.
Casino Journal, vol. 8, No. 6, Jun. 1993, "So You Want to be a Gambler", p. 1,5.
Las Vegas Sun "A New Game Introduced" Mar. 5, 1982.
Las Vegas Sportsbook "Sklansky Invents New Casino Games" Mar. 19–25, 1982.
Vegas World "Casino Poker".
Sklansky "Casino Poker" rule card, TX899,489, copyrighted Apr. 4, 1982.
Bob Stupak's Vegas World "Casino Poker Rules".
Information Disclosure Statement, Apr. 7, 1988, describing "Sklansky's Casino Poker" and "Video Poker".
Coin Hopper Model CH–500 and Model No. CH–750–U1 literature Asahi Seiko.
Jan. 26, 1993 Statement of Grounds and Particulars, by John Huxley Ltd., in opposition to Australian Petition for Patent Application No. 628044.
State of New Jersey Casino Control Commission PRN 217205 Civil Action, IGT's Second Amended Peitition for Authorization for the Implementation of the Game of Progressive 21, filed sometime after Aug. 4, 1992.
Review Journal, "Gamblers Take Chance at Million Dollar Payoff" by D.J. Boyer.
Winning Gamer, Issue #17, Feb. 1986, Pi Yee Press, La Jolla CA.
Scarne, Scarne's Encyclopedia of Games, "Hold'Em", Harper & Row Publishers, Copyright 1973, p. 14–18, 26.
Abercrobe & Fitch, Play Hours, 1960, p. 11, Blackjack Towel.
Scarne, Scarne's Encyclopedia of Games, copyright date unknown, p. 288.
Jim Kilby's Declaration under 37 C.F. R. 1.132.
TXU 184,603, Mar. 30, 1985.
Scarne, Scarne's Guide to Modern Poker, copyright unknown, p. 40, 60–61.
Request for Reexamination, U.S. Patent No. 4,861,041, issued Aug. 29, 1989; date of service, Jun. 20, 1995.
Request for Reexamination, U.S. Patent No. 4,861,041, issued Aug. 29, 1989; date of service, Sep. 2, 1993.
Request for Reexamination, U.S. Patent No. 5,288,077, issued Feb. 22, 1994; date of service, May, 26, 1995.
Request for Reexamination, U.S. Patent No. 5,364,105, issued Nov. 15, 1994; date of service, 5/296/95.
Asahi Seiko Catalog No. AV89C, Aug. 20, 1989; p. 44, 51 and Photograph "A".
Scarnes, Scarne's Encyclopedia of Games, Copyright 1973, p. 11, 31, 440–445.
Declaration of I. Nelson Rose, dated Jan. 26, 1989.
Declaration of Don Clark, dated Feb. 2, 1989.
Affidavit of Dennis Robie, dated Jan. 27, 1989.
Declaration of Mark A. Sincox, dated Feb. 7, 1989.
Declaration of John Edward Roethel, dated Feb. 7, 1989.
Commerce Casino Brochure Re Wisted' California Blackjack.
*D&D Gaming Patent, Inc. v. Rio Properties, Inc. et al.*: Case No.: CV–S–93–835–LDG–RLH; Defendants.
Request for Reexamination, U.S. Patent No. 5,377,973, issued Jan. 3, 1995.
PCT Written Opinion US 96/16409.
Royal Match 21 "Win Your Fortune" brochure, copyrighted 1991.
Fortune Card 21 "Win Your Fortune" Brochure, copyrighted 1991.
Winning Gamer, Issue #17, Feb. 1986.
Over/Under 13 Blackjack brochure.
Official Rules of Card Games, edited by A.H. Morehead, p. 78–93, copyright date 1968.
Specific Model Information Form FO–652–216.
Table Layout for "Casino Poker" Feb. 15, 1992.
TX 2 568 066 for Over/Under 13.
Supplement to Request for Reexam filed Under 1.510 served Mar. 25, 1998.

APPARATUS FOR PROGRESSIVE JACKPOT GAMING

CROSS REFERENCE TO RELATED APPLICATIONS

This application is a continuation of application Ser. No. 08/967,849, filed Nov. 12, 1997, which is a continuation of application Ser. No. 08/695,275, filed Aug. 9, 1996, and now U.S. Pat. No. 5,794,964, which is a continuation of application Ser. No. 08/486,700, filed Jun. 7, 1995, and now U.S. Pat. No. 5,544,893, which is a continuation of application Ser. No. 08/377,661, filed Nov. 8, 1994, and now U.S. Pat. No. 5,626,341 which is a division of application Ser. No. 08/040,925, filed Mar. 31, 1993, and now U.S. Pat. No. 5,364,104, which is a division of application Ser. No. 07/800,631 filed Nov. 27, 1991, now U.S. Pat. No. 5,288,077, which is a continuation-in-part of application Ser. No. 07/361,276, filed Jun. 5, 1989 and now U.S. Pat. No. 5,078,405; which is a division of application Ser. No. 07/214,934, filed Jul. 5, 1988 and now U.S. Pat. No. 4,861,041; which is a continuation-in-part of application Ser. No. 07/182,374, filed Apr. 18, 1988 and now U.S. Pat. No. 4,836,553. The entire disclosures of each of the above-listed applications and patents are hereby incorporated by reference herein. The entire disclosure of copending application Ser. No. 07/814,712 filed Dec. 30, 1991 is also hereby incorporated by reference herein.

BACKGROUND OF THE INVENTION

The present invention generally relates to casino or cardroom gaming involving a progressive jackpot. More particularly, it relates to a progressive jackpot that is available to be played by participants in various casino or cardroom table games.

It has become common practice in gaming establishments to provide a progressive jackpot component in connection with electronic or mechanical gaming devices, such as slot machines, video poker machines or keno machines. Typically a plurality or "bank" of machines are electronically interconnected to a common progressive jackpot meter. As gaming tokens are fed into each machine, the amount shown on the jackpot meter progresses incrementally until some lucky player lines up the winning combination, such as three or four 7's on the same row of a slot machine. In video poker, a Royal Flush normally wins the jackpot, although in some variations, a player must achieve a Royal Flush in an exact order, such as A-K-Q-J-10 from left to right, or in a particular suit, such as Spades. In video keno, a player typically must match 15 out of 15 numbers to win the progressive jackpot.

It is an object of the present invention to provide a progressive jackpot component to typically casino or cardroom table games such as poker or Twenty-One.

It is a feature of the present invention to have each participant in the progressive jackpot component win all or part of the amount shown on the progressive jackpot meter if the participant achieves a particular predetermined playing hand.

It is an advantage of the present invention that when the progressive jackpot component is added to typical table games such as poker or Twenty-One that the players will enjoy these games more and that the amount of play will increase.

It is a further object of the present invention to provide apparatus useful in providing the progressive jackpot component to casino or cardroom table games such as poker or Twenty-One.

It is a further feature of the present invention to have a progressive jackpot meter electronically interconnected to one or more gaming tables to allow each player at his playing location to participate in the progressive jackpot component by wagering a gaming token which automatically activates an indicator showing the player's participation and also automatically increments the progressive jackpot meter.

It is an advantage of the present invention that the apparatus makes it easy for each player to participate in the progressive jackpot component of the game.

BRIEF SUMMARY OF THE INVENTION

The method of the present invention generally involves a typical casino or cardroom game modified to include a progressive jackpot component. During the play of a Twenty-One game, for example, in addition to his normal wager, a player will have the option of making an additional wager that becomes part of, and makes the player eligible to win, the progressive jackpot. If the player's Twenty-One hand comprises a particular, predetermined arrangement of cards, the player will win all, or part of, the amount showing on the progressive jackpot. This progressive jackpot feature is also adaptable to any other casino or cardroom game such as Draw Poker, Stud Poker, Lo-Ball Poker or Caribbean Stud™ Poker.

The apparatus used to practice the present invention comprises a gaming table, such as those used for Twenty-One or poker, modified with the addition of a coin acceptor that is electronically connected to a progressive jackpot meter. When a player drops a coin into the coin acceptor, a light is activated at the player's location indicating that he is participating in the progressive jackpot component of the game during that hand. At the same time, a signal from the coin acceptor is sent to the progressive meter to increment the amount shown on the progressive meter. At the conclusion of the play of each hand, the coin acceptor is reset for the next hand. When a player wins all or part of the progressive jackpot, the amount showing on the progressive jackpot meter is reduced by the amount won by the player. Any number of gaming tables can be connected to a single progressive jackpot meter.

DETAILED DESCRIPTION OF THE PREFERRED EMBODIMENTS

Figure 1:
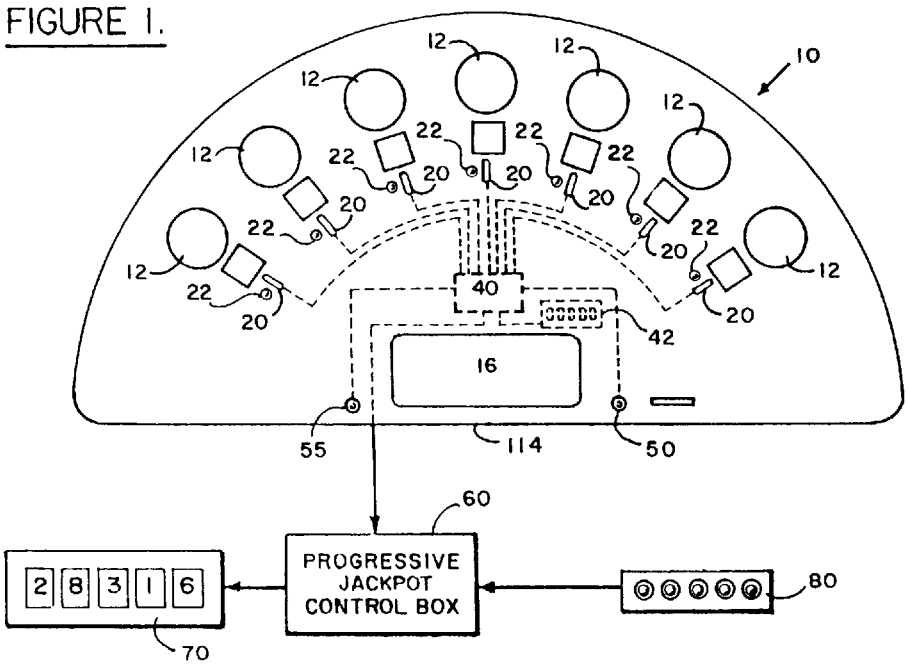
FIG. 1 shows the apparatus of the present invention using a casino gaming table with coin acceptors at each playing location electronically connected to a progressive jackpot meter.

As shown in FIG. 1, a casino gaming table 10 is provided having a plurality of playing locations 12 for players participating in the game being conducted, e.g., Twenty-One. A dealer is positioned at the dealer's location 14 adjacent a chip rack 16. Adjacent to each player location 12 is a coin acceptor 20. Each coin acceptor 20 is electronically connected to a main control board 40 to which is connected a number of odometer-type counters 42 corresponding to the number of playing locations 12 provided on the gaming table 10. As shown in FIG. 1, seven playing locations 12 are preferably provided, although the number of playing locations can be more or less than seven. A reset switch 50 is located adjacent the dealer's location 14 and is electronically connected to the main control board 40 and provides a means whereby the dealer can reset the coin acceptors 20 prior to the beginning of the play of each hand. A lockout switch 55, is also provided adjacent to the dealer's location 14 which is activated by the dealer to prevent later wagering as will be more fully explained herein.

A main control board 40 is electronically connected to a progressive jackpot control box 60 which receives the signals from each coin acceptor 20 and in response to those signals increments the progressive jackpot meter 70, as will be more fully explained herein. Also electronically connected to the progressive control box 60 is the jackpot reset control 80 which provides moans for resetting the amount shown on the progressive jackpot meter whenever a player wins all, or part of, the amount shown on the progressive jackpot meter 70.

In operation, the present invention operates as follows. A conventional Twenty-One game is conducted on gaming table 10. At the beginning of each hand, each player, in addition to making his usual wager for the play of the Twenty-One hand, may also make an additional wager to be eligible to participate in the progressive jackpot component of the game during that hand. To do so, a player places a gaming token into the coin acceptor 20 associated with that player's particular playing location 12. As will be more fully explained herein, the coin acceptor 20 "recognizes" that a gaming token has been placed therein and an indicator signal 22, preferably a light, adjacent to the coin acceptor 20 is activated showing that that particular player is participating in the progressive jackpot component of the game during the play of that hand.

Besides activating the indicator signal 22, the coin acceptor 20 also sends an electronic signal to the main control board 40. This signal is sent by the main control board 40 to the odometer-type counter 42 corresponding to the particular playing location 12 to keep a sequential count of the number of gaming tokens that are placed in the particular coin acceptor 20.

The main control board 40 also activates the progressive jackpot control box 60 which in turn controls the progressive jackpot meter 70. Each gaming token placed in a coin acceptor 20 results in the amount shown on the progressive jackpot meter being increased by a predetermined amount. If, for example, each gaming token has a value of one dollar, then the amount shown on the progressive jackpot meter would be increased by any amount up to one dollar for each gaming token placed into a coin acceptor 20. In the preferred embodiment of the present invention, the progressive jackpot would be increased between 93% to 97% of the amount of each gaming token being wagered, the balance representing the house's share of the amount wagered for providing the progressive jackpot component of the game.

When each player has had a reasonable opportunity to make a progressive jackpot wager, the dealer activates lockout switch 55 which deactivates each coin acceptor 20. Any tokens placed in a coin acceptor 20 after lockout switch 55 is activated will not register. This prevents late wagering after the cards are dealt.

The amount shown on the progressive jackpot meter will continue to increase for each gaming token wagered until a player achieves a winning hand. Preselected winning hands earn a player all or part of the amount shown on the progressive jackpot meter. In a preferred embodiment, the preselected winning hands and payoff amounts in Twenty-One game are as follows:

| Winning Hand | Amount of Jackpot |
|---|---|
| Four 5's and an Ace | 100% |
| Ace, two, three, four, five and six | 4% |
| Six, seven and eight of same suit | 100 tokens |
| Three 7's | 50 tokens |

The invention is not limited to these particular combinations of winning hands or payoffs; other winning hand combinations or payoff amounts can be utilized.

When a player achieves a winning hand, the jackpot reset control 80 is manually activated by pushing a button that corresponds to the type of hand that the player achieved. The amount won by the player is thus electronically deducted from the amount showing on the progressive jackpot meter.

When a particular hand is completed at gaming table 101, the dealer presses the reset switch 50, which deactivates the indicator signal 22. Lockout switch 55 is also manually deactivated by the dealer. The coin acceptor 20 is thus readied to receive another gaming token for the next hand.

The progressive jackpot component of the present invention can also be used in connection with other types of casino games, e.g., Caribbean Stud™ Poker, which is the subject matter of U.S. patent application Ser. No. 182,374 filed Apr. 10, 1988, which is incorporated herein by reference thereto. Caribbean Stud™ Poker is a modification of conventional five-card stud poker. Each player makes an ante and a dealer deals five cards to each player and to himself. The player's cards are dealt face down and the dealer's cards are dealt four cards face down and one card face up. Each player views his hand then decides whether to continue to play by making an additional bet or to fold or drop, in which case he loses his ante. The dealer then reveals his entire hand; if the dealer's hand does not have a poker value of at lest Ace-King, then the dealer is not permitted to continue to play. In that case, the dealer pays even money on the remaining players' antes, and returns their bets to them. If the dealer's hand has a poker value of Ace-King or better, the dealer compares his hand to each player's hand, paying or collecting the bets as appropriate. The dealer also pays odds of more than even money on each winning player's hand of two pair or better according to a bonus payment schedule. This game can be played using the gaming table shown in FIG. 1. Each player makes a progressive jackpot wager by placing a gaming token in the coin acceptor 20 which makes that player eligible to participate in the progressive jackpot amount shown on the meter 70. The winning hands and amounts for Caribbean Stud Poker are preferably as follows:

| Hand | Amount |
|---|---|
| Royal Flush | 100% |
| Straight Flush | 10% |

-continued

| Hand | Amount |
|---|---|
| Four of a Kind | 1% |
| Full House | 50 tokens |
| Flush | 25 tokens |

Again the invention is not limited to these particular combinations of hands or payoff amounts; other hand combinations or payoff amounts can be utilized.

Figure 2:
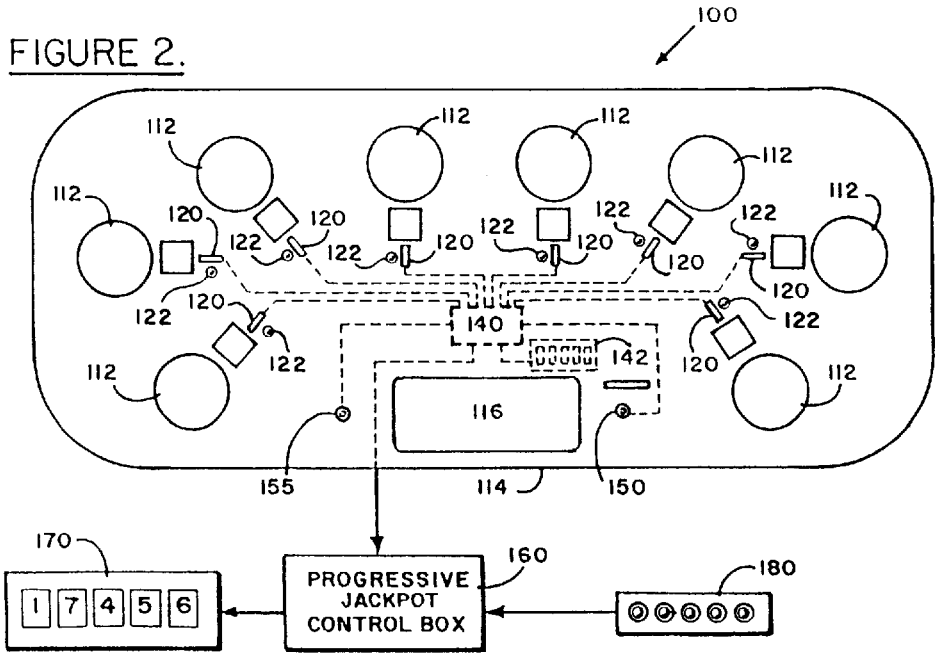
FIG. 2 shows an alternate embodiment of the present invention using a cardroom gaming table with coin acceptors at each playing location electronically connected to a progressive jackpot meter.

The invention can also be adapted to other casino or cardroom poker games such as Stud Poker, Draw Power or Lo-Ball Poker. The gaming table 100 used to play each of these games is modified as shown in FIG. 2 by the addition of coin acceptors 120 and indicator signals 122 at each player's location 112. The electronics is the same as that shown in FIG. 1 and includes a main control board 140, an odometer-type counter 142, a progressive jackpot control box 160, a progressive jackpot meter 170 and a jackpot reset control 180. A reset switch 150 and a lockout switch 155 are located adjacent the dealer's location 114 next to the chip rack 116.

The progressive jackpot meter 170 is incrementally increased in the same manner as that described in connection with FIG. 1 by each player placing a gaming token in the coin acceptor 120.

The winning hands and payoff amounts are preselected as appropriate for the type of game being played. In the preferred embodiment, the winning hands and payoff amounts are as follows:

| Hand | Amount |
|---|---|
| I. Five Card Draw Poker | |
| Royal Flush | 100% |
| Straight Flush | 10% |
| Four of a Kind | 100 tokens |
| Full House | 25 tokens |
| II. Five Card Stud Poker | |
| Royal Flush | 100% |
| Straight Flush | 10% |
| Four of a Kind | 100 tokens |
| Full House | '25 tokens |
| III. Seven Card Stud Poker | |
| Royal Flush | 100% |
| Straight Flush | 10% |
| Four of a Kind | 100 tokens |
| Full House | 25 tokens |
| IV. Lo-Ball Poker | |
| 5-4'-3-2-Ace | 100% |
| 6-4-3-2-Ace | 5% |
| 6-5-3-2'-Ace | 100 tokens |
| 7-4-3-2-Ace | 25 tokens |

These winning hands and payoff amounts are merely preferred embodiments and the invention may be practiced using any appropriate combination of winning hands and payoff amounts.

As an alternative embodiment, progressive jackpot component of the game may be utilized as a consolation payoff for a player who otherwise loses during the play of the regular game. For example, assume the regular game being played if Five Card Stud. Players A and B are both eligible for the progressive jackpot amount because each has placed a gaming token in the coin acceptor prior to the beginning of the play of the hand. Player A holds a hand having Four of a Kind. Player B holds a Full House. Because Player A's hand is higher according to the customary poker hand ranking priority, Player A wins the pot wagered on the Five Card Stud game. As a consolation, however, Player B receives a payoff amount from the progressive jackpot for his Full House, e.g., 25 tokens. Player A does not receive a payoff from the progressive jackpot because he already has won the pot from the regular Five Card Stud game. Thus, under this alternative embodiment, a player only receives a payoff from the progressive jackpot if the player both has a hand of the preselected type and loses to a higher hand in the game being played.

Another modification would have the two players sharing in the progressive jackpot amount; the player with the preselected type of hand receiving a percentage of the progressive jackpot amount and the player with the higher poker hand receiving the rest of the progressive jackpot amount. With reference to the example above, Player B would receive 80% of the progressive jackpot amount for a Full House and Player A would receive 20% of the progressive jackpot amount for a Full House.

Figure 3:
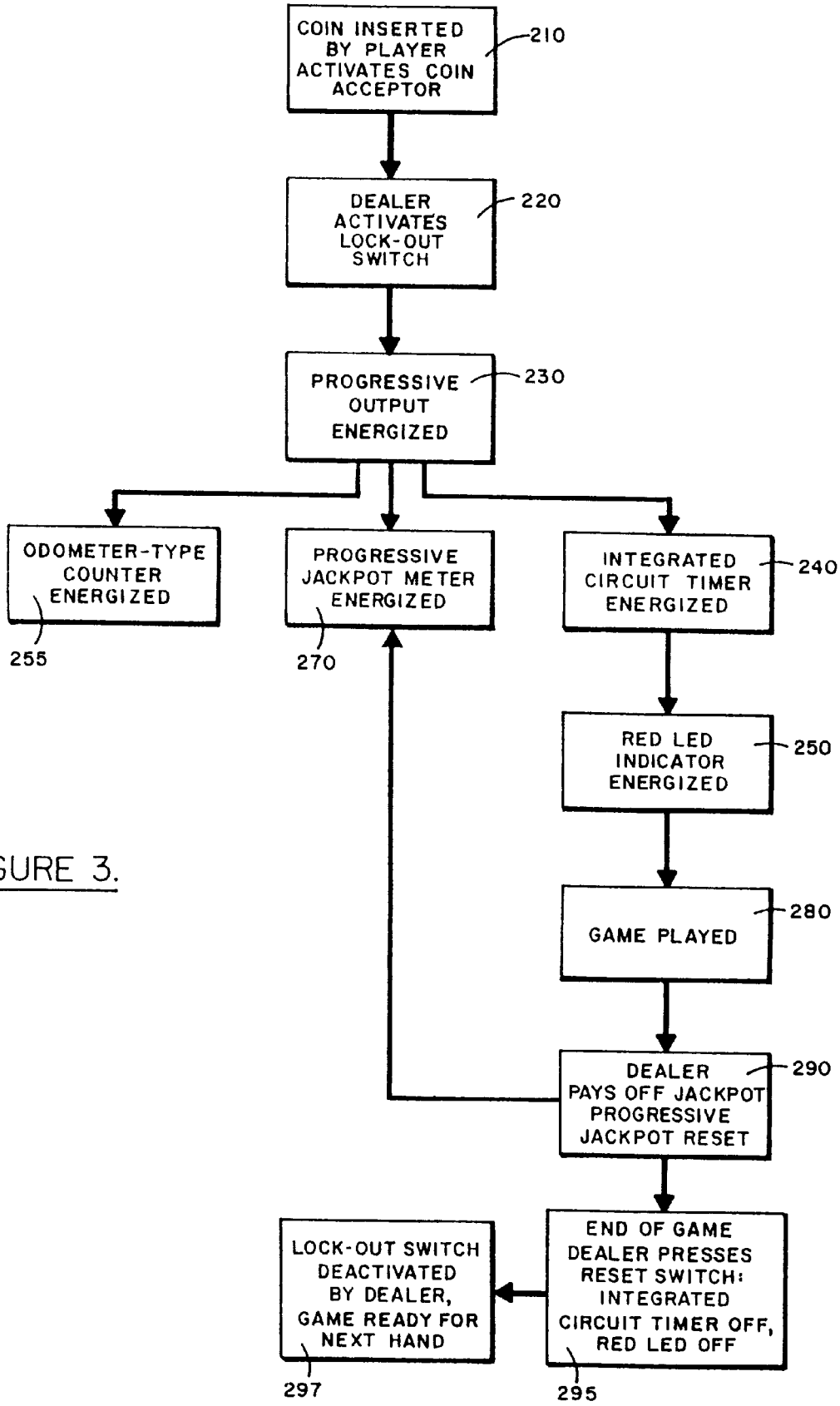
FIG. 3 shows a block diagram of the operation of the present invention.

FIG. 3 shows in block diagram form the operation of the present invention. Each playing location has a coin a acceptor 210 into which a player places a gaming token in order to be eligible for the progressive jackpot amount. When all players have had sufficient time to decide whether to participate in the progressive jackpot for that hand the dealer activates the lockout switch 220 which prevents into wagers. Each gaming token placed in a coin acceptor 210 energizes the progressive output control 230 which in turn activates three separate devices. An integrated circuit timer is energized which causes an indicator light 250 to be illuminated at the location on the coin acceptor in front of the player. This gives a visual indication to the dealer that that player is participating in the progressive jackpot during the play of that hand.

The signal from the progressive jackpot control 230 also activates an odometer-type counter 255 which increments by one unit for each gaming token wagered through the coin acceptor. This allows the gaming establishment to keep an accurate count of the number of wagers made on the progressive jackpot.

The third signal from the progressive jackpot control 230 goes directly to the progressive jackpot meter 270. The progressive jackpot meter 270 shows the total amount available to be won by a player who obtains one of the preselected winning hands. The amount of the progressive jackpot meter 270 automatically increases a predetermined amount for each gaming token placed in a coin acceptor. The progressive jackpot meter 270 is programmed to increase a specified percentage of the amount wagered in the coin acceptor 210. In the preferred embodiment, the progressive jackpot meter will be increased between about 93% and 97% of the amount wagered in the coin acceptor 210.

The dealer then deals the cards to each player and the hand is played 280. If a player has a preselected winning hand, the player is paid the amount corresponding to the type of winning hand that the player has. The jackpot reset control 290 is manually activated which results in the amount of the payoff being automatically deducted from the amount displayed on the progressive jackpot meter 270.

After the winning players have been paid, the dealer activates the reset switch 295 which both turns off the integrated circuit timer 240 and turns off the indicator light 250 and the dealer deactivates the lockout switch 297 thereby activating the coin acceptor 210 for the next hand.

Figure 4:
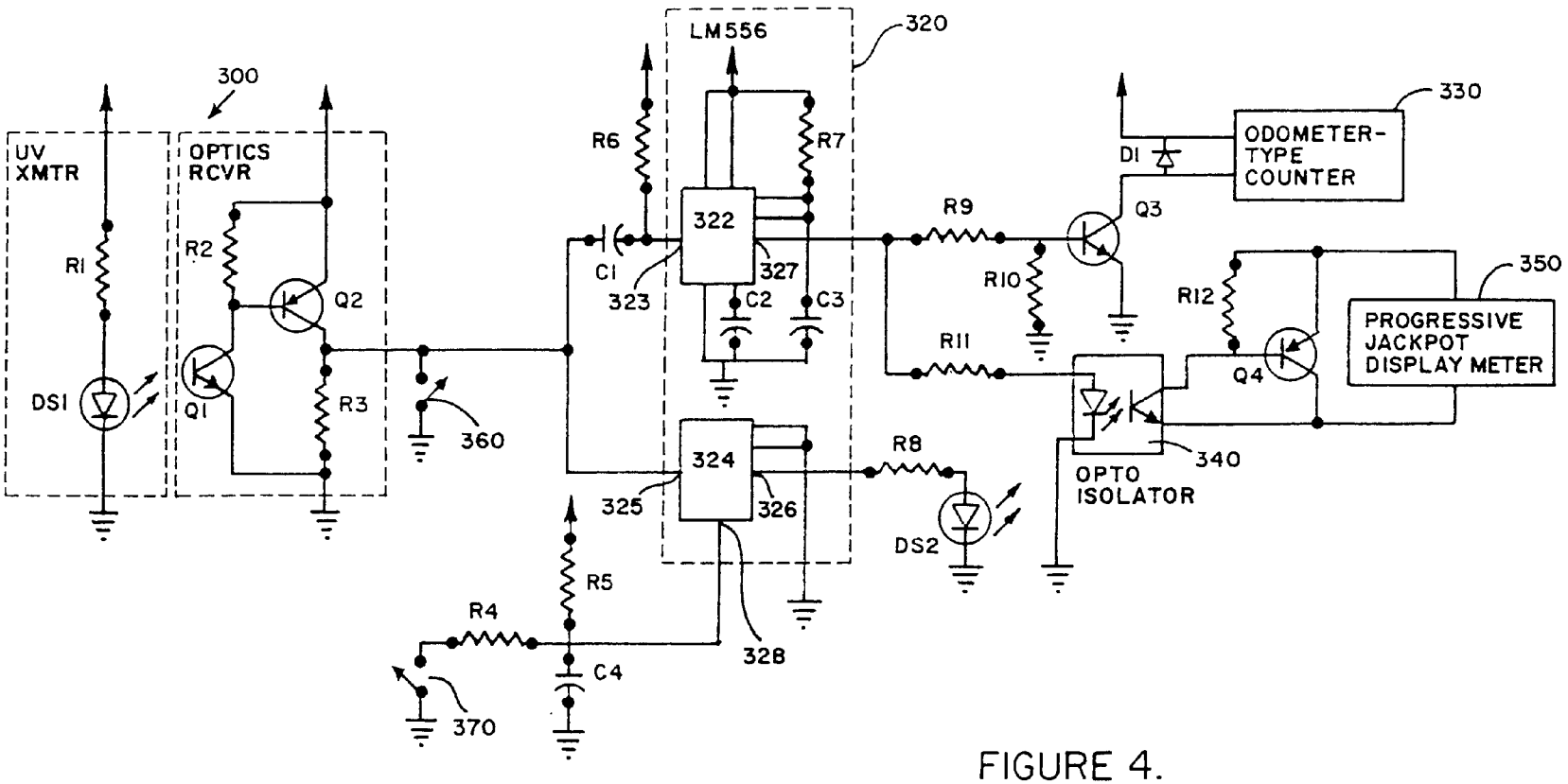
FIG. 4 shows a schematic diagram of the electronic circuitry of the present invention.

FIG. 4 in schematic form depicts the electronic circuitry to operate the apparatus of the present invention. The coin acceptor circuitry 300 is activated when a gaming token is dropped into the slot on the gaming table where the coin acceptor is mounted. The gaming token passes between an ultraviolet transmitter DS1 and an optic receiver Q1 (Model #MRD 300 transistor). This causes a pulse to be passed from the collector of Q1 to the base of receiver Q2. Q2 is a Model #2N3906 transistor and acts as an emitter follower and sends a pulse which is received by the integrated circuit 322,324 of the main control board 320. The integrated circuit 322, 324 is a Model #LM-55G Timer. The pulse from Q2 is received at pin 325 of the lower portion 324 of the integrated circuit and this pulse causes pin 326 of the lower portion 324 to go high and turn on diode DS2 (a Model P367 diode). This diode DS2 is the indicator light 22 shown in FIG. 1 and this indicator light 22 stays on until the play of the hand is finished.

The pulse from Q2 also is received by pin 323 on the upper portion 322 of the integrated circuit and this pulse creates a pulse at pin 327 of the upper portion 322 which causes transistor Q3 (a Model #TIP120 transistor) to turn on, then off for the duration of the pulse created at pin 327. The turning on and off of transistor Q3 causes the odometer-type counter 42 shown in FIG. 1 to increment on digit. The odometer-type counter 330 is a six-digit non-resetable electronic 12 VDC counter, WICO Model #31-443400.

The pulse created at pin 327 of the upper portion 322 of the integrated circuit also goes to the opto isolator 340 (which is a Model #811A16E Opto Isolator). The opto isolator 340 passes this pulse to the base of transistor Q4 (a Model #2N390G transistor) thereby turning on transistor Q4 for the duration of the pulse. When transistor Q4 is turned on, the pulse is passed to the progressive jackpot display meter 350 where the amount shown on the display meter 350 is increased by a predetermined percentage of the value of the gaming token placed in the coin acceptor 300. The progressive jackpot display meter 350 can typically be a Game Technology Model having 3" LED characters on a 44" length single progressive display.

After all bets are made, the dealer manually presses a lockout switch 360 which will clamp the output of transistor Q2 at a low level which ensures that there can be no late wagers made through the coin acceptor 300. Once the output of transistor Q2 is clamped at a low level, a gaming token placed in the coin acceptor 300 will not cause a pulse to flow through the rest of the circuitry.

The game is then played and once the game is completed, the dealer will manually press the reset switch 370 which creates a reset pulse that activates pin 320 which resets the lower portion 324 of the integrated circuit. This resetting causes pin 326 to go low which will extinguish diode DS2 which turns off the indicator light 22 on the gaming table.

The dealer also manually presses the lockout switch 360 to open the circuit and remove the clamp on the emitter of transistor Q2 which allows another hand to be played. The players commence the next hand by placing gaming tokens in the coin acceptor 300 and the process is repeated.

As will be apparent to those skilled in the art, various resistors and capacitors are provided to complete the circuitry. The specifications on the resistors and capacitors shown in FIG. 4 is as follows:

| Resistors | Capacitors |
|---|---|
| R1-60 Ohm | C1-.1 ufd/35 v |
| R2-3 Kohm | |
| R3-1 Kohm | C2-.01 Ufd/35 v |

-continued

| Resistors | Capacitors |
|---|---|
| R4-200 Ohm | |
| R5-4.7 Kohm | C3-.1 ufd/35 v |
| R6-10 Kohm | |
| R7-1 Mohm | C4-.1 ufd/35 v |
| R8-240 Ohm | |
| R9-1 Kohm | |
| R10-4.7 Kohm | |
| R11-240 Ohm | |
| R12-1 Kohm | |

Figure 5:
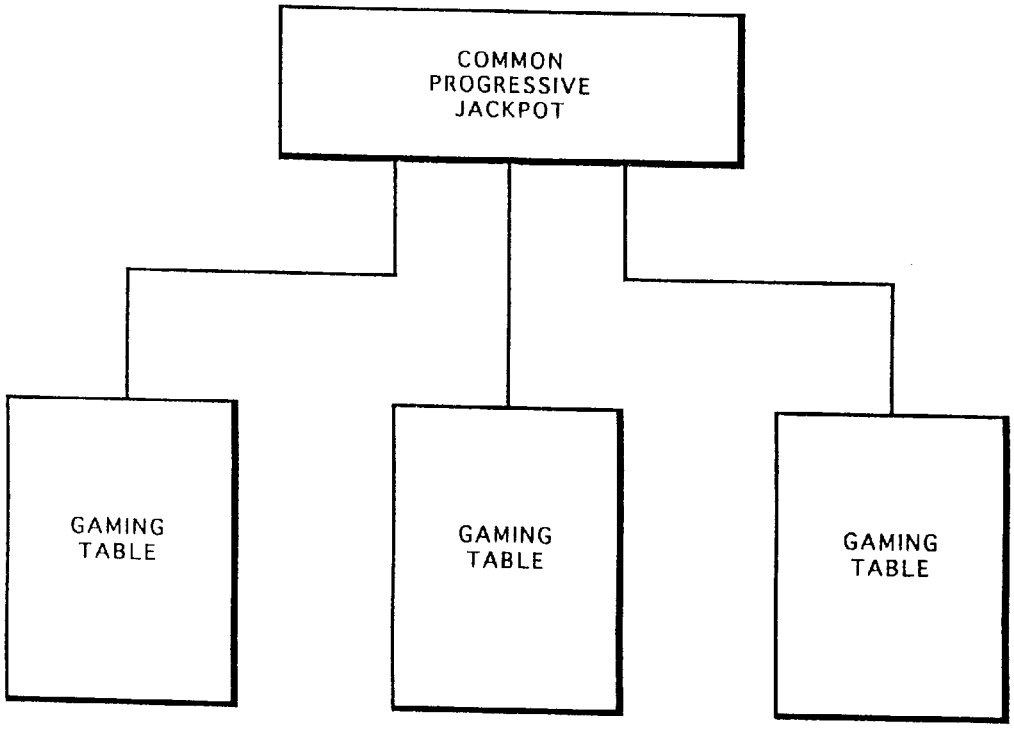
FIG. 5 shows a block diagram of a plurality of gaming tables connected to a single progressive jackpot meter.

As shown in FIG. 5, any number of gaming tables may be connected to a single progressive jackpot meter.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. An apparatus for including a jackpot component as an additional feature in a table game comprising:

(a) a gaming table having a plurality of player locations at which a player receives playing cards from a live human dealer at a dealer location;

(b) means associated with each player location for receiving a gaming token by which the player makes a wager to participate in the additional jackpot component of the table card game;

(c) means for indicating on a jackpot meter the amount in the jackpot;

(d) means for increasing the amount shown on the jackpot meter a preselected amount for each gaming token wagered; and (e) means operable by the dealer for decrementing the amount shown on the jackpot meter by the amount won by a player if the player achieves a predetermined arrangement of the playing cards.

2. The apparatus of claim 1 further comprising indicator signal means associated with each playing location for indicating that a gaming token has been wagered.

3. The apparatus of claim 1 further comprising an indicator associated with each playing location for indicating that a gaming token has been wagered.

4. The apparatus of claim 1 further comprising a light indicator associated with each playing location for indicating that a gaming token has been wagered.

5. The apparatus of claim 1 further comprising a plurality of said gaming tables electronically interconnected to a common jackpot component.

6. The apparatus of claim 1 further comprising a jackpot reset control means operable by the dealer including a plurality of buttons such that manual activation of one of said buttons corresponding to a particular one of a plurality of predetermined winning arrangements of the playing cards achieved by a player decrements the amount shown on the jackpot meter in accordance wit a predetermined payoff table.

7. The apparatus of claim 1 further comprising a jackpot reset control means operable by the dealer for decrementing the amount shown on said jackpot meter upon achievement by a player of a particular one of a plurality of predetermined winning arrangements of the playing cards in accordance with a predetermined payoff table.

8. The apparatus of claim 1 further comprising lockout switch means operable by the dealer for preventing a player from participating in said jackpot component after activation of said lockout switch means.

9. The apparatus of claim 1 further comprising a sensor for recognizing wagering of a gaming token.

10. The apparatus of claim 1 further comprising a light sensor for recognizing wagering of a gaming token.

11. The apparatus of claim 1 further comprising reset switch means operable by the dealer for resetting the apparatus at the end of each hand of the game.

12. The apparatus of claim 1 further comprising means adjacent the dealer location for independently registering placement of gaming token at each of said player locations.

13. An apparatus for including a jackpot component as an additional feature in a table card game comprising:

(a) a gaming table having a plurality of player locations at which a player receives playing cards from a live human dealer at a dealer location;

(b) an activator associated with each player location to activate said additional jackpot component for the player to participate in the additional jackpot component of the table card game;

(c) means for indicating on a jackpot meter the amount in the jackpot;

(d) means for increasing the amount shown on the jackpot meter a preselected amount for each player activation of said additional jackpot component; and (e) a jackpot reset control operable by the dealer for decrementing the amount shown on the jackpot meter by the amount won by a player if the player achieves a predetermined arrangement of the playing cards.

14. An apparatus for including a jackpot component as an additional feature in a table card game, comprising:

(a) a gaming table having a plurality of player locations at which a player receives playing cards from a live human dealer at a dealer location to play said table card game;

(b) an acceptor associated with each player location for accepting a gaming token by which a player makes a wager to participate in the additional jackpot component of the table card game;

(c) a light indicator associated with each playing location for visually indicating that a player was wagered a gaming token to participate in the jackpot component of the table card game;

(d) a manually activated lockout switch operable by the dealer adapted for manual activation by the dealer for preventing a player from participating in said jackpot component by making a wager after activation of said lockout switch by the dealer; and (e) manually activated reset switch operable by the dealer for resetting the apparatus at the end of each hand of the table card game upon activation of said reset switch by the dealer.

15. The apparatus of claim 14, further comprising a jackpot control operable by the dealer including a plurality of buttons adjacent said dealer location adapted for manual activation by the dealer, said buttons corresponding to a plurality of predetermined winning arrangements of the playing cards achieved by a player for winning a preselected payoff amount in accordance with a predetermined payoff table.

16. The apparatus of claim 14, further comprising a plurality of card gaming tables electronically interlinked to a common jackpot component.

17. The apparatus of claim 14, further comprising a counter connected with said acceptors for counting wagers for said jackpot component.

18. The apparatus of claim 14, further comprising a sensor operably associated with each acceptor for recognizing wagering of a gaming token.

19. The apparatus of claim 14, wherein said table game comprises poker.

20. The apparatus of claim 14, wherein said table card game consists essentially of stud poker.

21. An apparatus for including a jackpot component as an additional feature in a table card game, comprising:

(a) a gaming table having a plurality of player locations at which a player receives playing cards from a live human dealer at a dealer location to play said table card game;

(b) an acceptor associated with each player location for accepting a gaming token by which a player optionally makes a wager to participate in the additional jackpot component of the table card game;

(c) an electronic sensor operably associated with each acceptor for recognizing wagering of a gaming token;

(d) a counter operably associated with said acceptors for counting wagers for said jackpot component;

(e) a light indicator associated with each playing location for visually indicating that a player has wagered a gaming token to participate in the jackpot component of the table card game;

(f) a manually activated lockout switch operable by the dealer adapted for manual activation by the dealer for preventing a player from participating in said jackpot component by making a wager after activation of said lockout switch by the dealer; and (g) a manually activated reset switch operable by the dealer for resetting the apparatus at the end of each hand of the table card game upon activation of said reset switch by the dealer.

22. The apparatus of claim 21, further comprising a jackpot control operable by the dealer including a plurality of buttons adjacent said dealer location adapted for manual activation by the dealer, said buttons corresponding to a plurality of predetermined winning arrangements of the playing cards achieved by a player for winning a preselected payoff amount in accordance with a predetermined payoff table.

23. The apparatus of claim 21, further comprising a plurality of card gaming tables electronically interlinked to a common jackpot component.

24. The apparatus of claim 21, further comprising a counter connected with said acceptors for counting wagers for said jackpot component.

25. The apparatus of claim 21, wherein said table game comprises poker.

26. The apparatus of claim 21, wherein said table game consists essentially of stud poker.

27. In an apparatus for including a jackpot component as an additional feature in a table card game, (a) a gaming table having a plurality of player locations at which a player receives playing cards from a live human dealer at a dealer location and places a first wager to play said table card game; and (b) an electronic activator associated with each player location to activate said additional jackpot component in response to a player's making a second wager by which the player participates in the additional jackpot component of the table card game.

28. The apparatus of claim 27, further comprising a jackpot control including a plurality of buttons adapted for manual activation by the dealer, said buttons corresponding to a plurality of predetermined winning arrangements of the playing cards achieved by a player for winning a preselected payoff amount in accordance with a predetermined payoff table.

29. The apparatus of claim 28 further comprising a control system electronically linked to said activators and operative to maintain an accounting of second wagers placed and payoff amounts won.

30. The apparatus of claim 27 further comprising a plurality of gaming tables electronically interlinked to a common jackpot component.

31. The apparatus of claim 27 further comprising a counter electronically interconnected with said activators and adapted to count second wagers.

32. The apparatus of claim 27 wherein said table game comprises poker.

33. The apparatus of claim 27 wherein said table card game consists essentially of stud poker.

34. The apparatus of claim 27 further comprising an indicator associated with each playing location to indicate that the activator has activated said additional jackpot component such that a player is participating in said additional jackpot component when a player has placed said second wager to participate in said jackpot component.

35. The apparatus of claim 34 wherein said indicator comprises a light.

36. The apparatus of claim 27 further comprising a manually activated lockout switch adapted for manual activation by the dealer for preventing a player from participating in said jackpot component by making a wager after activation of said lockout switch by the dealer.

37. The apparatus of claim 27 further comprising a manually activated reset switch for resetting the apparatus at the end of each hand of the table card game upon activation of said reset switch by the dealer.

38. The apparatus of claim 27 further comprising a jackpot meter operably associated with said activators for indicating the amount in the jackpot.

39. The apparatus of claim 38 further comprising a plurality of card gaming tables electronically interlinked to a common jackpot.

40. The apparatus of claim 27 wherein said table card game consists essentially of Twenty-One.

41. The apparatus of claim 27 wherein said table card game consists essentially of CARIBBEAN STUD® poker.

42. The apparatus of claim 27 wherein said table card game consists essentially of draw poker.

43. A table for playing a table card game having a jackpot component as an additional feature, wherein the wager to participate in the jackpot component is optional and separate from wagers for the card game, said table game including:

(a) an electronic sensor operatively associated with said table and operative to sense the placement of a gaming token for participation in the jackpot component; and (b) an indicator operative to produce a signal to indicate whether a gaming token has been sensed by said sensor for participation in the jackpot component.

44. A table according to claim 43 wherein said sensor includes an optical detector operative to sense the presence of a gaming token.

45. A table according to claim 43 wherein said signal comprises a light signal.

46. A table according to claim 45 wherein said light signal remains constant during the entire play of a hand of the card game.

47. A table according to claim 45 wherein said light signal remains on during the play of a hand of the card game if said sensor has sensed a gaming token and remains off during the play of a hand of the card game if said sensor has not sensed a gaming token.

48. A table according to claim 43 further including a counter electronically interconnected to said sensor and operative to count gaming tokens recognized by said sensor.

49. A table according to claim 43 wherein said jackpot is progressive.

50. A table according to claim 43 wherein said jackpot includes preselected, fixed fee jackpot payout amounts.

51. A table according to claim 43 further including a controller electronically interconnected with said sensor and operative to register the occurrence of sensing the placement of a gaming token by said sensor.

52. A table according to claim 51 further including a manually operable lock out switch operatively connected to deactivate said sensor such that said controller does not register the occurrence of sensing the placement of a gaming token by said sensor.

53. A table for playing a card game having a jackpot component as an additional feature, wherein the wager to participate in the jackpot component is optional and separate from wagers for the card game, said table including:

(a) an electronic sensor operatively associated with said table and operative to sense the placement of a gaming token for participation in the jackpot component; and (b) a counter electronically interconnected to said sensor and adapted to count gaming tokens sensed by said sensor.

54. A table for playing a card game having a jackpot component as an additional feature, wherein the wager to participate in the jackpot component is optional and separate from wagers for the card game, said table including:

(a) an electronic sensor operatively associated with said table to recognize the placement of a gaming token for participation in the jackpot component;

(b) a controller electronically interconnected with said sensor and operative to register the occurrence of sensing the placement of a gaming token by said sensor; and (c) a manually operable lock out switch operatively connected to deactivate said sensor such that said controller does not register the occurrence of the placement of a gaming token.

55. A table according to claim 54 wherein said jackpot includes a preselected, fixed fee jackpot payout amount.

56. A table according to claim 54 further including a meter electronically interconnected to said sensor and operative to count gaming tokens recognized by said sensor and registered by said controller.

57. In a card gaming table for playing a card game having a jackpot component as an additional feature wherein the wager to participate in the jackpot component is optional and separate from wagers for the card game, said table comprising a plurality of player locations at which a player receives playing cards from a dealer and a jackpot control including a plurality of buttons adapted for manual activation by the dealer, said buttons corresponding to a plurality of predetermined winning arrangements of the playing cards achieved by a player for winning a preselected payoff amount in accordance with a predetermined payoff table.

58. In a live card game table, said table having a plurality of player locations at which a player receives playing cards from a human dealer to play said live table card game, (a) a plurality of electronics sensors, one sensor associated with a corresponding one of said player locations for sensing placement of a gaming token wagered by the player;

(b) a plurality of light indicators, one indicator associated with a corresponding one of said player locations, for visually indicating that a player has wagered a gaming token; and (c) a counter electronically interconnected with said sensors and adapted to count tokens wagered by said players.

59. Apparatus for including a component as an additional feature to a live table game, in which game a player may make a first wager to play said live table game, and in which component a player may make a second, separate, additional wager and may win a separate, additional payoff amount, said apparatus including:

(a) a table at which the game is played, said table having a plurality of player locations and a dealer location for a human dealer;

(b) a plurality of electronic sensors, one electronic sensor associated with a corresponding one of said player locations, each sensor operative to sense the making of said second wager by a player; and (c) a plurality of indicators, one indicator associated with a corresponding one of said player locations, each indicator operative in response to a corresponding one of said sensors to produce a signal indicating whether a player has made said second wager.

60. The apparatus according to claim 59, further comprising at least one counter electronically connected with said sensors, said counter operative to count second wagers made by said players.

61. The apparatus according to claim 60 further comprising a control system electronically linked to said sensors for maintaining an accounting of said second wagers made and payoff amounts won.

62. The apparatus according to claim 61 wherein said separate, additional payoff amount includes a preselected, fixed fee amount.

63. The apparatus according to claim 59, wherein each said electronic sensor includes an optical detector operative to sense the placement of a gaming token as a wager.

64. The apparatus according to claim 59 wherein each said indicator comprises a light signal operative to stay on during the play of the game if said corresponding electronic sensor senses the making of said second wager.

65. The apparatus according to claim 64 wherein said light signal is operative to stay off during the play of the game if said corresponding electronic sensor does not sense the making of said second wager.

66. The apparatus according to claim 65 further comprising a controller electronically interconnected with each of said sensors and operative to register the occurrence of sensing the making of said second wager by each of said sensors.

67. The apparatus according to claim 66 further comprising a lock out switch operatively connected to deactivate said sensors such that said controller does not register the occurrence of sensing the making of said second wager by said sensors.

68. The apparatus according to claim 67 further comprising a control system electronically linked to said sensors for maintaining an accounting of said second wagers made and payoff amounts won.

69. The apparatus according to claim 68 wherein said separate, additional payoff amount includes a preselected, fixed fee amount.

70. The apparatus according to claim 67 wherein said separate, additional payoff amount includes a preselected, fixed fee amount.

71. The apparatus according to claim 65 further comprising a control system electronically linked to said sensors for maintaining an accounting of said second wagers made and payoff amounts won.

72. The apparatus according to claim 71 wherein said separate, additional payoff amount includes a preselected, fixed fee amount.

73. The apparatus according to claim 65 wherein said separate, additional payoff amount includes a preselected, fixed fee amount.

74. The apparatus according to claim 65 wherein said separate payoff amount includes a preselected, fixed fee amount.

75. The apparatus according to claim 59 further comprising a controller electronically interconnected with each of said sensors and operative to register the occurrence of sensing the making of said second wager by each of said sensors.

76. The apparatus according to claim 75 further comprising a lock out switch operatively connected to deactivate said sensors such that said controller does not register the occurrence of sensing the making of said second wager by said sensors.

77. The apparatus according to claim 76 further comprising a control system electronically linked to said sensors for maintaining an accounting of said second wagers made and payoff amounts won.

78. The apparatus according to claim 77 wherein said separate, additional payoff amount includes a preselected, fixed fee amount.

79. The apparatus according to claim 59 further comprising a control system electronically linked to said sensors for maintaining an accounting of said second wagers made and payoff amounts won.

80. The apparatus according to claim 79 wherein said separate, additional payoff amount includes a preselected, fixed fee amount.

81. The apparatus according to claim 59 wherein said separate, additional payoff amount is progressive.

82. The apparatus according to claim 59 wherein said separate, additional payoff amount includes a preselected, fixed fee amount.

83. Apparatus for including a component as an additional feature to a live table game, which component includes a wager optional and separate from the wagers for said live table game by which optional wager a player may win a separate, additional payoff amount, said apparatus including:

(a) a table at which the game is played, said table including at least one player location and a dealer location for a human dealer;

(b) an electronic sensor operative to sense the making of said optional wager by a player; and (c) an indicator operative in response to said sensor to produce a signal indicating whether a player has made said optional wager.

84. The apparatus according to claim 83 further comprising a counter electronically connected with said sensor, said counter operative to count said optional wagers made by a player.

85. The apparatus according to claim 83 wherein said electronic sensor includes an optical detector operative to sense the placement of a gaming token as a wager.

86. The apparatus according to claim 83 wherein said indicator comprises a light signal operative to stay on during the play of the game if said electronic sensor senses the making of said optional wager.

87. The apparatus according to claim 86 wherein said light signal is operative to stay off during the play of the game if said electronic sensor does not sense the making of said optional wager.

88. The apparatus according to claim 87 further comprising a controller electronically interconnected with each of said sensors and operative to register the occurrence of sensing the placement of a gaming token by said sensor.

89. The apparatus according to claim 88 further comprising a lock out switch operably connected to deactivate said sensor such that said controller does not register the occurrence of sensing the making of said optional wager by said sensor.

90. The apparatus according to claim 89 wherein said separate payoff amount includes a preselected, fixed fee amount.

91. The apparatus according to claim 83 further comprising a controller electronically interconnected with said sensor and operative to register the occurrence of sensing the making of said optional wager by said sensor.

92. The apparatus according to claim 91 further comprising a lock out switch operably connected to deactivate said sensor such that said controller does not register the occurrence of sensing the making of said optional wager by said sensor.

93. The apparatus according to claim 92 wherein said separate payoff amount includes a preselected, fixed fee amount.

94. The apparatus according to claim 83 further comprising a control system electronically linked to said sensor for maintaining an accounting of optional wagers made and additional payoff amounts won.

95. The apparatus according to claim 94 wherein said separate payoff amount includes a preselected, fixed fee amount.

96. The apparatus according to claim 83 wherein said separate payoff amount is progressive.

97. The apparatus according to claim 83 wherein said separate payoff amount includes a preselected, fixed fee amount.

98. Apparatus for including a component as an additional feature to a live table game, in which game a player may make a first wager to play said live table game and in which component a player may make a second, separate, optional, additional wager and may win a separate additional payoff amount, said apparatus including:

(a) a table at which the game is played, said table having a plurality of player locations and a dealer location for a human dealer;

(b) an electronic device associated with each player location by which a player makes said second wager; and (c) an electronic indicator associated with each player location and operatively connected to said electronic device to produce a signal indicating that a player has made said second wager.

99. The apparatus of claim 98 wherein said electronic device includes a sensor operative to detect a gaming token.

100. Apparatus for including a component as an additional feature to a table game, in which game a player may make a first wager to play said table game and in which component a player may make a second, separate, optional, additional wager and may win a separate, additional payoff amount, said apparatus including:

(a) a table at which the game is played, said table including at least one player location and a dealer location for a human dealer;

(b) an electronic device operatively associated with said table by which a player makes said second wager; and (c) a control system electronically linked to said electronic device and operative to maintain an accounting of second wagers made and payoff amounts won.

101. The apparatus claim 100 further including an electronic indicator operatively connected to said electronic device to produce a signal indicating that a player has made said second wager.

102. A table for playing a game having a jackpot component as an additional feature, wherein the wager to participate in the jackpot component is optional and separate from wagers for the game, said table including:

(a) a coin acceptor operatively associated with said table and operative to recognize placement of a gaming token for participation in the jackpot component; and (b) an indicator operative to produce a signal to indicate whether a gaming token has been recognized by said coin acceptor for participation in the jackpot component.

103. A table according to claim 102 wherein said coin acceptor includes an optical detector operative to sense the presence of a gaming token.

104. A table according to claim 102 wherein said signal comprises a light signal.

105. A table according to claim 102 further including a counter electronically interconnected to said coin acceptor and operative to count gaming tokens recognized by said coin acceptor.

106. A table according to claim 102 wherein said jackpot is progressive.

107. A table according to claim 102 wherein said jackpot includes preselected, fixed fee jackpot payout amounts.

108. A table according to claim 102 further including a controller electronically interconnected with said coin acceptor and operative to register the occurrence of recognition of the placement of a gaming token by said coin acceptor.

109. A table according to claim 108 further including a manually operable lock out switch operatively connected to deactivate said coin acceptor such that said controller does not register the occurrence of recognition of the placement of a gaming token by said coin acceptor.

110. A table for playing a game having a jackpot component as an additional feature, wherein the wager to participate in the jackpot component is optional and separate from wagers for the game, said table including:

(a) a coin acceptor operatively associated with said table and operative to recognize the placement of a gaming token for participation in the jackpot component; and (b) a counter electronically interconnected to said coin acceptor and adapted to count gaming tokens recognized as being placed by said coin acceptor.

* * * * *